US005131416A

United States Patent [19]

Gentry

[11] Patent Number: 5,131,416

[45] Date of Patent: Jul. 21, 1992

[54] CIGARETTE

[75] Inventor: Thomas L. Gentry, Winston-Salem, N.C.

[73] Assignee: R. J. Reynolds Tobacco Company, Winston-Salem, N.C.

[21] Appl. No.: 628,545

[22] Filed: Dec. 17, 1990

[51] Int. Cl.[5] ..... A24D 1/02

[52] U.S. Cl. ..... 131/365; 131/335; 131/336; 131/331

[58] Field of Search ..... 131/365, 334, 335, 336, 131/359

[56] References Cited

U.S. PATENT DOCUMENTS

| | | | |
|---|---|---|---|
| 3,395,714 | 8/1968 | Kahane et al. . | |
| 3,633,589 | 2/1970 | Kahane et al. . | |
| 3,744,496 | 7/1973 | McCarty et al. . | |
| 3,902,504 | 9/1975 | Owens, Jr. et al. . | |
| 4,108,151 | 8/1978 | Martin et al. . | |
| 4,225,536 | 9/1980 | Cline et al. . | |
| 4,231,377 | 11/1980 | Cline et al. . | |
| 4,407,308 | 10/1983 | Baker et al. . | |
| 4,420,002 | 12/1983 | Cline . | |
| 4,450,847 | 5/1984 | Owens . | |
| 4,461,311 | 7/1984 | Mathews et al. . | |
| 4,505,282 | 3/1985 | Cogbill et al. . | |
| 4,561,454 | 12/1985 | Guess . | |
| 4,589,775 | 5/1986 | Milhous et al. . | |
| 4,607,647 | 8/1986 | Dashley et al. . | |
| 4,615,345 | 10/1986 | Durocher . | |
| 4,622,983 | 11/1986 | Mathews et al. . | |
| 4,624,268 | 11/1986 | Baker et al. . | |
| 4,637,410 | 1/1987 | Luke . | |
| 4,649,943 | 3/1987 | Gonterman | 131/336 |
| 4,691,717 | 9/1987 | Ikeda et al. . | |
| 4,779,631 | 10/1988 | Durocher et al. . | |
| 4,881,557 | 11/1989 | Martin . | |
| 4,911,184 | 3/1990 | Case et al. . | |
| 4,915,118 | 4/1990 | Kaufman et al. . | |
| 4,924,883 | 5/1990 | Perfetti et al. . | |
| 4,924,888 | 5/1990 | Perfetti et al. . | |
| 4,941,486 | 7/1990 | Dube et al. . | |
| 4,942,888 | 7/1990 | Montova et al. . | |
| 4,984,589 | 1/1991 | Riedesser . | |
| 4,998,543 | 3/1991 | Goodman et al. . | |

FOREIGN PATENT DOCUMENTS

| | | |
|---|---|---|
| 0262550 | 9/1987 | European Pat. Off. . |
| 0342538 | 5/1989 | European Pat. Off. . |

*Primary Examiner*—V. Millin
*Assistant Examiner*—Lynne A. Reichard

[57] ABSTRACT

A cigarette includes a charge or roll of smokable material (e.g., tobacco cut filler) circumscribed by two layers of paper wrapping materials. The first or inner wrapping material includes a cellulosic base web, tobacco, and magnesium oxide and/or magnesium hydroxide within the web. The second or outer wrapping material circumscribes and overwraps the first wrapping material, has a cellulosic base web and inorganic filler material, and exhibits an air permeability of below about 8 CORESTA units. The cigarette is capable of sustaining smolder under FTC smoking conditions while yielding very low levels of visible sidestream smoke.

22 Claims, 1 Drawing Sheet

CIGARETTE

BACKGROUND OF THE INVENTION

The present invention relates to cigarettes which burn tobacco, and in particular to cigarettes, which when smoked, generate low amounts of visible sidestream smoke.

Popular smoking articles, such as cigarettes, have a substantially cylindrical rod shaped structure and include a charge of smokable material such as shredded tobacco (e.g., in cut filler form) surrounded by a paper wrapper thereby forming a so-called "tobacco rod". Normally, a cigarette has a cylindrical filter element aligned in an end-to-end relationship with the tobacco rod. Typically, a filter element includes cellulose acetate tow circumscribed by plug wrap, and is attached to the tobacco rod using a circumscribing tipping material.

Cigarettes are employed by the smoker by lighting one end thereof and burning the tobacco rod. The smoker then receives mainstream smoke into his/her mouth by drawing on the opposite end (e.g., the filter end) of the cigarette. During the time that the cigarette is burning, sidestream smoke is generated. Sidestream smoke is smoke which directly enters the atmosphere from the lite end of the cigarette. Sidestream smoke diffuses into the atmosphere, and the characteristic visible nature thereof may be perceived negatively by some individuals. The relative amount of visible sidestream smoke generated by a burning cigarette is related to the amount of sidestream "tar" generated by that burning cigarette. Typical cigarettes of about 84 mm length (e.g., having a tobacco rod length of about 57 mm and a filter element length of about 27 mm) often yield about 25 to about 35 mg of sidestream "tar" per cigarette. See, for Proctor et al, *Analyst*, Vol. 113, p. 1509 (1988), for an apparatus and technique for determining the sidestream "tar" of a cigarette.

Numerous cigarettes which reportedly yield relatively low levels of visible sidestream smoke have been proposed. See, for example, U.S. Pat. Nos. 4,108,151 to Martin; 4,225,636 to Cline; 4,231,377 to Cline; 4,407,308 to Baker; 4,420,002 to Cline; 4,450,847 to Owens; 4,461,311 to Mathews; 4,561,454 to Guess; 4,624,268 to Baker et al and 4,637,410 to Luke.

It would be desirable for the cigarette manufacturer to provide a good tasting cigarette which (i) provides good smoking satisfaction, (ii) sustains smolder at least during FTC smoking conditions, and (iii) generates low levels of sidestream "tar" and hence low levels of visible sidestream smoke.

SUMMARY OF THE INVENTION

The present invention relates to a cigarette which delivers good tobacco flavor, pleasure and satisfaction while generating relatively low levels of sidestream "tar". Such cigarettes also exhibit extremely low levels of visible sidestream smoke as well as low levels of sidestream odor. Cigarettes of the present invention (i) have a weight which is not overly excessive, (ii) yield an acceptable ash and fire cone, (iii) yield acceptable smolder properties, and (iv) yield a burn rate which is acceptable. Further, such cigarettes have a tendency to (i) burn back uniformly during use, and (ii) not provide visible staining of the outer wrap immediately behind the char line during use.

Cigarettes of the present invention include a charge or roll of smokable material contained in two layers of circumscribing outer wrapping materials to form a so-called "tobacco rod." The tobacco rod is such that a first (i.e., inner) wrapping material circumscribes the smokable material, and a second (i.e., outer) wrapping material circumscribes the first wrapping material. The smokable material is a smokable filler material usually comprising tobacco cut filler material. Normally, the smokable material is all tobacco cut filler material, which is cased and/or top dressed.

The second or outer layer of wrapping material surrounding the roll of smokable material is a paper having a low air permeability. Wrapping materials having a low air permeability or low porosity typically exhibit a permeability below about 8 CORESTA units, normally about 5 CORESTA units or less. A CORESTA unit is a measure of the linear air velocity which passes through a 1 $cm^2$ area of wrapper at a constant pressure of 1 centibar. See CORESTA Publication ISO/TC 126/SC I N159E (1986).

The first or inner wrapping material surrounding the roll of smokable material is a paper containing magnesium oxide and/or magnesium hydroxide. Preferred inner wrapping materials also incorporate tobacco of some form. The inner wrapping material also can incorporate a carbonaceous material. Usually, the amount of magnesium oxide and/or magnesium hydroxide within the inner paper wrapping material exceeds about 5 percent, based on the total weight of that paper. Usually, the amount of optional carbonaceous material within the inner paper wrapping material exceeds about 5 percent, based on the total weight of the paper.

Preferred cigarettes of the present invention include a filter element which acts as a mouthpiece. Such cigarettes can be air diluted (e.g., by perforating the tipping material in the region which overlies the filter elements or by other such air dilution means). The filter element can have a high, moderate or low filtration efficiency for particulate matter; and the filter element can have one or more longitudinally positioned segments. Some cigarettes employ moderate to low efficiency filter elements, and the filter element is ventilated to provide a cigarette having an air dilution between about 10 and about 75 percent. As used herein, a low filtration efficiency is a filtration efficiency of less than about 40. See, Keith in Schemeltz's *The Chemistry of Tobacco and Tobacco Smoke*, p. 157 (1972). As used herein, the term "air dilution" is the ratio (expressed as a percentage) of the volume of air drawn through the air dilution means to the total volume of air and smoke drawn through the cigarette and exiting the extreme mouthend portion of the cigarette. See, Selke et al, *Beitr. Zur Tabak. In.*, Vol. 4, p. 193 (1978).

DETAILED DESCRIPTION OF THE PREFERRED EMBODIMENTS

Figure 1:
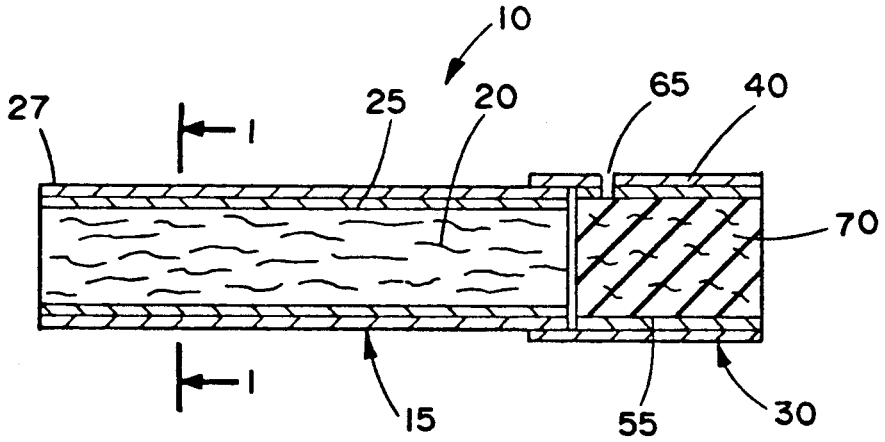
FIG. 1 is a longitudinal sectional view of a cigarette of this invention.

A preferred embodiment of a cigarette of this invention is shown in FIG. 1. The cigarette 10 includes a generally cylindrical rod 15 of smokable material 20, such as tobacco cut filler, contained in a first circumscribing inner wrapping material 25 and a second or outer wrapping material 27 circumscribing the first wrapping material. The first and second circumscribing wrapping materials directly contact one another (i.e., the inner surface of the outer wrapping material contacts the outer surface of the inner wrapping material). As such, the outer wrapping material overwraps the inner wrapping material. The rod 15 is hereinafter referred to as a "tobacco rod". The ends of the tobacco rod 15 are open to expose the smokable material. The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough.

Figure 1A:
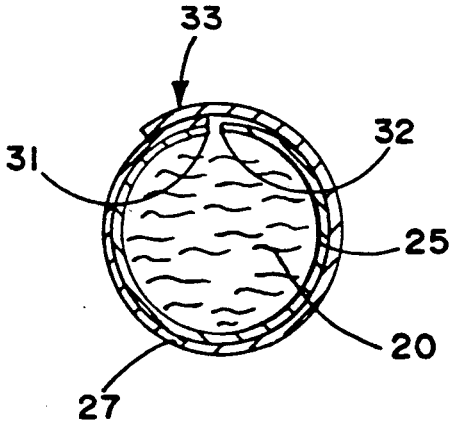
FIGS. 1A and 1B are cross-sectional radial views of the cigarette shown in FIG. 1 taken along lines 1—1 in FIG. 1.

Referring to FIG. 1A, smokable material 20 is contained in a first circumscribing inner wrapping material 25, and a second outer wrapping material 27 circumscribes the first wrapping material. The first wrapping material 25 is formed into a circular shape such that the ends 31, 32 of the sides thereof abut one another. The ends 31, 32 of wrapping material 25 can abut one another (as shown in FIG. 1A), nearly abut one another, or slightly overlap one another. The second wrapping material 27 includes a lap zone 33 including a suitable adhesive therebetween so as to form a secure outer wrapper. As such, the width of the inner wrapping material is less than that of the outer wrapping material. A cigarette rod having such a configuration can be provided by supplying paper wrappers from two bobbins on a suitably equipped cigarette making machine, positioning the inner wrapping material on top of the outer wrapping material, passing the two wrapping materials so positioned through the garniture region of the cigarette making machine, and forming the tobacco rod. A preferred apparatus for manufacturing a cigarette is described in U.S. patent application Ser. No. 609,975, filed Nov. 6, 1990. Such an apparatus includes a garniture region including a movable belt which travels along a predetermined path; a bobbin for supplying the outer wrapping material onto the movable belt of the garniture so as to travel along the path of the movable belt; and another bobbin for supplying the inner wrapping material onto the outer wrapping material on the movable belt so as to travel along the path of the movable belt. The other bobbin supplies the inner wrapping material using a turner assembly including a movable base; a first bar for receiving that wrapping material from the bobbin and for changing the path of that wrapping material along a path substantially perpendicular to the path of the movable belt; and a second bar for receiving that wrapping material from the first bar and for changing the path of the wrapping material to a direction substantially parallel to the outer wrapping material so as to place the inner wrapping material onto the first while on the movable belt.

Figure 1B:
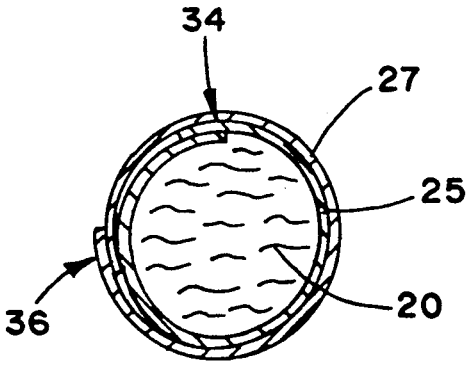

Referring to FIG. 1B, smokable material 20 is contained in a first circumscribing inner wrapping material 25, and a second outer wrapping material 27 circumscribes the first wrapping material. The first wrapping material 25 is formed into a circular shape such that a lap zone 34 including a suitable adhesive therebetween is formed. The second wrapping material includes a lap zone 36 including a suitable adhesive therebetween so as to form a secure outer wrapper. A cigarette rod having such a configuration can be provided by forming a cigarette rod using known techniques, and then wrapping the rod so formed with an outer wrapping material. Equipment for providing a cigarette in such a manner will be apparent to the skilled artisan.

The smokable material 20 employed in the manufacture of the tobacco rod can vary. For example, the smokable material of the cigarette can have the form of filler (e.g., such as tobacco cut filler). As used herein, the terms "filler" or "cut filler" are meant to include tobacco materials and other smokable materials which have a form suitable for use in the manufacture of tobacco rods for cigarettes. As such, filler can include smokable materials which are blended and are in a form ready for cigarette manufacture. The filler materials normally are employed in the form of strands or shreds as is common in conventional cigarette manufacture. For example, the cut filler material can be employed in the form of strands or shreds from sheet-like or "strip" materials which are cut into widths ranging from about 1/20 inch to about 1/60 inch, preferably from about 1/25 inch to about 1/35 inch. Generally, such strands or shreds have lengths which range from about 0.25 inch to about 3 inches.

Examples of suitable types of tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. Certain reconstituted tobacco materials are described in U.S. patent application Ser. Nos. 414,833, filed Sept. 29, 1989; 416,332, filed Sep. 29, 1990; 406,637, filed Sep. 13, 1989 and 567,520, filed Aug. 15, 1990. In certain aspects, the smokable material or blend of smokable materials consists essentially of tobacco filler material or consists only of tobacco filler material. Smokable materials can be cased and top dressed as is conventionally performed during various stages of cigarette manufacture. As such, the smokable material, and particularly tobacco filler material, can include casing and/or top dressing components. For example, blend components such as flavoring agents and humectants can be applied to the smokable material, as is commonly performed when cigarettes are manufactured. See, Leffingwell et al, *Tobacco Flavoring For Smoking Products* (1972). Suitable flavoring agents include vanillin, tobacco extracts such as tobacco essences and tobacco aroma oils, cocoa, licorice, menthol, and the like. Flavor modifying agents such as levulinic acid can be applied to the smokable material (e.g., in amounts ranging from about 0.01 to about 2 percent, normally from about 0.1 to about 1 percent, preferably about 0.2 to about 0.6 percent, based on the dry weight of the smokable material). Such components conveniently are applied to the smokable material as casing and top dressing components.

Typically, the tobacco rod 15 has a length which ranges from about 35 mm to about 85 mm, preferably about 40 to about 70 mm; and a circumference of about 17 mm to about 27 mm, preferably about 22.5 mm to about 25 mm. Short cigarette rods (i.e., having lengths from about 35 to about 50 mm) can be employed, particularly when smokable blends having a relatively high packing density are employed.

The second wrapping material 27 is a cigarette wrapping material having a low air permeability value. For example, such wrapping materials have air permeabilities of less than about 8 CORESTA units, sometimes less than about 5 CORESTA, often less than about 3 CORESTA units, and frequently less than about 1 CORESTA unit. Such wrapping materials include a cellulosic base web (e.g., provided from wood pulp and/or flax fibers) and inorganic filler material (e.g., calcium carbonate particles). A suitable wrapping material is a cigarette paper consisting essentially of calcium carbonate and flax which is available as Reference No. TOD 03816 from Ecusta Corp. Also suitable are cigarette papers manufactured from wood pulp and inorganic fillers such as calcium carbonate. For example, a suitable cigarette paper is available as P-2540-21 from Kimberly-Clark Corp. Particularly preferred second or outer wrapping materials include an amount of a polymeric film forming agent sufficient to provide a desirably low air permeability. For example, a sufficient amount of polymeric film forming agent can be applied to a paper wrapper having an air permeability of from about 10 to about 30 CORESTA units to provide a paper having an air permeability of less than about 8 CORESTA units, sometimes less than about 5 CORESTA units, often less than about 3 CORESTA units, and frequently less than about 1 CORESTA unit. Similarly, a sufficient amount of an aqueous solution of a polymeric film forming agent can be applied to a paper wrapper having a relatively low air permeability (e.g., less than about 10 CORESTA units) to provide a paper having yet a lower air permeability (e.g., less than about 5 CORESTA units, and frequently less than about 1 CORESTA unit). One wrapping material is available as P-2540-83 from Kimberly-Clark Corp.: which is a paper having a basis weight of about 32 g/m$^2$ and an initial permeability of about 6 CORESTA units to which 3.4 weight percent sodium carboxymethylcellulose has been applied to provide a final permeability of about 0.7 CORESTA units. Another wrapping material is available as P-2540-84 from Kimberly-Clark Corp.; which is a paper having a basis weight of about 31 g/m$^2$ and an initial permeability of about 17 CORESTA units to which 3.5 weight percent sodium carboxymethylcellulose is applied to provide a final permeability of about 5.1 CORESTA units. Another wrapping material is available as P-2540-82 from Kimberly-Clark Corp.; which is a paper having a basis weight of about 32 g/m$^2$ and an initial permeability of about 6 CORESTA units to which 1 weight percent sodium carboxymethylcellulose is applied to provide a final permeability of about 4 CORESTA units. Another wrapping material is available as P-2540-80 from Kimberly-Clark Corp.; which is a paper having a basis weight of about 32 g/m$^2$ and an initial porosity of about 6 CORESTA units to which 1.6 weight percent sodium carboxymethylcellulose is applied to provide a final permeability of about 2.7 CORESTA units. Another wrapping material is available as P-2540-81 from Kimberly-Clark Corp.; which is a paper having a basis weight of about 32 g/m$^2$ and an initial permeability of about 6 CORESTA units to which 2.6 weight percent sodium carboxymethylcellulose is applied to provide a final permeability of about 1.7 CORESTA units. Other wrapping materials having basis weights of about 30 g/m$^2$, air permeabilities of less than about 2 CORESTA units, having about 1 weight percent low viscosity ammonium alginate or sodium carboxymethylcellulose applied, and having about 4 to about 7 weight percent potassium citrate applied, are available as P-2831-60-1, P-2831-102, P-2831-140 and P-2831-179 from Kimberly-Clark Corp.

The outer wrapping material normally includes a burn chemical. Typically, the amount of burn chemical does not exceed about 10 percent; but usually is greater than about 0.25 percent, based on the dry weight of the wrapping material. Examples of burn chemicals are potassium citrate, sodium citrate, potassium acetate, sodium succinate, potassium nitrate and potassium succinate. Methods of application of such salts to the wrapping material will be apparent to the skilled artisan.

The first or inner wrapping material 25 comprises magnesium oxide and/or magnesium hydroxide and a cellulosic (e.g., base web) material. The wrapping material also includes some form of tobacco. If desired, a certain amount of a further inorganic filler material (e.g., particles of calcium carbonate) can be incorporated into the paper. The magnesium oxide and magnesium hydroxide normally are employed in powder or particulate form. The amount of magnesium oxide and/or magnesium hydroxide present within the inner wrapping material typically exceeds about 5 percent, and frequently exceeds about 10 percent; but normally does not exceed about 30 percent, based on the dry weight of the wrapping material.

The inner wrapping material most preferably includes tobacco of some form. Normally, the tobacco has the form of shredded tobacco stem, tobacco laminae, or other such form of tobacco parts having a cellulosic component. The tobacco also can have a processed form, and can be in the form of an extract. The amount of tobacco within the inner wrapping material can vary, and typically exceeds about 25 percent, and frequently exceeds about 50 percent; but normally does not exceed about 95 percent, based on the dry weight of the wrapping material.

The inner wrapping material normally includes a burn chemical. Typically the amount of burn chemical does not exceed about 10 percent; but usually is greater than about 0.25 percent, based on the dry weight of the wrapping material. Certain wrapping materials can have very low or be absent of added burn chemical, particularly if that material includes a relatively high level of an aqueous tobacco extract therein. In particular, wrapping materials having an aqueous tobacco extract content of greater than about 25 percent, usually greater than about 30 percent, based on the dry weight of the wrapping material, can be employed without the presence of any added burn chemical.

The inner wrapping material can include cellulosic materials such as flax fibers, wood pulp, and the like, as well as combinations thereof with tobacco parts.

The inner wrapping material can include further inorganic filler materials. Examples include calcium sulfate particles, calcium sulfate fibers, particles of calcium carbonate, agglomerated calcium carbonate, particles, as well as the inorganic filler materials described in U.S. patent application Ser. No. 414,833, filed Sep. 29, 1989.

The inner wrapping material can include a carbonaceous material (i.e., material consisting primarily of carbon). The amount of optional carbonaceous material within the wrapping material can vary. Typical paper inner wrapping materials have relatively high levels of carbonaceous material and/or incorporate carbonaceous materials formed under relatively high pyrolysis temperatures when outer wrapping materials are of relatively low porosity. Normally, the amount of the carbonaceous material within the inner wrapping material is less than about 50 percent, often less than about 40 percent, and frequently less than about 25 percent, based on the weight thereof. The form of the carbonaceous material can vary; but is typically in powder or particulate form of about 5 microns to about 20 microns in diameter.

The carbonaceous material of the inner wrap can vary. The carbonaceous material is combustible under those conditions (i.e., temperatures) experienced during the period that the cigarette is smoked. The carbonaceous material most preferably is derived from natural cellulosic materials. Certain natural cellulosic materials have a high cellulose content (i.e., a cellulose content above about 80 weight percent), and often a high alpha-cellulose content (i.e., an alpha-cellulose content above about 80 weight percent). Examples of natural cellulosic materials which can be pyrolyzed to provide combustible carbonaceous materials include tobacco materials, softwood pulp, hardwood pulp, coconut hulls, kapok fibers, cotton fibers, cotton linters, and the like, as well as combinations thereof. Combustible carbonaceous materials typically are provided by pyrolyzing a natural cellulosic material under inert (e.g., nitrogen) atmosphere at temperatures between about 600° C. and about 1,200° C., preferably between about 650° C. and about 850° C. Preferred carbonaceous materials include at least about 80 weight percent carbon, normally include about 85 weight percent and about 95 weight percent carbon. Exemplary carbonaceous materials are set forth in European Patent Application No. 236,992; U.S. patent application Ser. No. 378,551, filed Jul. 11, 1989; and U.S. patent application Ser. No. 414,833, filed Sep. 29, 1989.

The amount of optional carbonaceous material within the inner wrapping material relative to the total weight of the tobacco rod can vary. Typically, the inner wrap comprises greater than about 2, often about 2 to about 8, and frequently about 3 to about 7 percent carbonaceous material therewithin, based on the total weight of the tobacco rod. Typically, when the outer wrapping material has a porosity which is extremely low (i.e., about 2 CORESTA units or less), the inner wrapping material often has a relatively high content of carbonaceous material therewithin (i.e., about 5 percent or more, based on the weight of the tobacco rod).

The permeability of the inner wrapping material can vary, but typically is higher than the permeability of the outer wrapping material, and frequently is quite high relative to the outer wrapping material. Normally, the ultimate permeability provided by the combined wrapping materials is slightly less than that permeability of the outer wrapping material; however, effects of the inner wrapping material towards lowering the ultimate permeability of the combined wrapping materials are less in instances in which the differences between the permeabilities of the inner and outer wrapping materials are relatively great. As such, the net permeability provided by both of the wrapping materials approaches about ½ of the permeability exhibited by the wrapping material having the lesser permeability. Generally, the permeability of the inner wrapping material is above about 15 CORESTA units, usually above about 50 CORESTA units, often is above about 100 CORESTA units, and frequently above about 200 CORESTA units, although the permeability of the wrapping material can approach about 1,000 CORESTA units.

Certain flavoring agents can be incorporated into or otherwise carried by the inner wrapping material. In particular, the carbonaceous material of the inner wrapping material can act as a substrate for certain flavoring agents. Examples of suitable flavoring agents include menthol, vanillin, and the like. Suitable flavoring agents are set forth in Leffingwell et al, *Tobacco Flavoring For Smoking Products* (1972). The carbonaceous material is a particularly good substrate for volatile flavoring agents. The inner wrapping material also can carry certain forms of tobacco, such as tobacco extracts, essences and aroma oils, as well as finely divided tobacco particles and tobacco dust.

The packing densities of the blend of smokable materials contained within the wrapping materials can vary. Typical packing densities for tobacco rods of cigarettes of this invention range from about 150 to about 300 mg/cm$^3$. Normally, packing densities of the tobacco rods range from about 200 to about 280 mg/cm$^3$.

The filter element 30 normally is attached to the tobacco rod 15 by tipping material 40 which circumscribes both the entire length of the filter element and an adjacent region of the tobacco rod. The inner surface of the tipping material 40 is fixedly secured to the outer surface of the plug wrap 55 and the outer surface of the wrapping material 27 of the tobacco rod, using a suitable adhesive. A ventilated or air diluted cigarette is provided with an air dilution means such as a series of perforations 65 which extend through the tipping material and plug wrap.

Typically, the filter element 30 has a length which ranges from about 15 mm to about 35 mm, preferably about 25 mm to about 30; and a circumference of about 17 mm to about 27 mm, preferably about 22 mm to about 25 mm. Filter material 70 normally is provided from fibrous materials such as cellulose acetate or polypropylene tow. The plug wrap 55 typically is a conventional paper plug wrap, and can be either air permeable or essentially air impermeable. However, if desired, nonwrapped cellulose acetate filter elements can be employed to provide the various segments. The filter elements can provide a wide range of mainstream smoke removal efficiencies. Exemplary filter elements are described in U.S. patent application Ser. No. 567,519, filed Aug. 15, 1990. The various filter element segments suitable for use in this invention can be manufactured using known cigarette filter making techniques and equipment.

Typically, the tipping material circumscribes the filter element and an adjacent region of the tobacco rod such that the tipping material extends about 3 mm to about 6 mm along the length of the tobacco rod. Typically, the tipping material is a conventional paper tipping material and is adhesively secured to the filter element and the adjacent region of the tobacco rod. The tipping material can have a permeability which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of this invention, the amount of air dilution can vary. Often, the amount of air dilution for an air diluted cigarette is greater than about 10 percent, and frequently greater than about 25 percent. The upper limit of air dilution for a cigarette typically is less than about 75 percent, more frequently less than about 65 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

Cigarettes of the present invention, when smoked, generally yield less than about 20 mg, preferably less than about 10 mg of sidestream "tar" per cigarette, as determined using the apparatus and techniques described by Proctor et al, *Analyst*, Vol. 113, p. 1509 (1988). Such cigarettes normally provide more than about 6 puffs, preferably more than about 8 puffs per cigarette when smoked under FTC conditions. FTC conditions consist of 35 ml puffs of 2 second duration separated by 58 seconds of smolder. Normally, cigarettes of the present invention provide less than about 15 puffs, and often less than about 12 puffs, when smoked under FTC conditions. Normally, cigarettes of the present invention yield less than about 2 mg, preferably less than about 1.5 mg, and most preferably less than about 1 mg of sidestream "tar" per 1 minute puff cycle period, when smoked under FTC conditions.

Cigarettes of the present invention, when smoked, yield ash and firecone which are acceptable. The ash is not overly dark in color, is not easily dislodged from the cigarette, and is not flaky. The firecone is of acceptable length, is not overly cohesive, and is not overly fragile (i.e., maintains its integrity).

Cigarettes of the present invention maintain smolder under static burning conditions (i.e., without puffing after the lighting puff). Much preferred cigarettes maintain smolder for at least about 3 minutes, more preferably at least about 5 minutes, and often at least about 7 minutes, without self-extinguishing. Preferred cigarettes are such that at least about one third of the burnable length of the tobacco rod, often at least about one half of the burnable length of the tobacco rod, and frequently the total burnable length of the tobacco rod is consumed during static burning conditions without self-extinguishing.

Cigarettes of the present invention burn at an acceptable rate during smoking, particularly under free smolder (i.e., static burning) conditions. Typical cigarettes of the present invention, and particularly those cigarettes having a circumference of about 24 mm to about 25 mm, exhibit a static burn rate of less than about 5 mm/min., and frequently between about 1.5 mm/min. and about 4 mm/min.

The following examples are provided in order to further illustrate the invention but should not be construed as limiting the scope thereof. Unless otherwise noted, all parts and percentages are by weight.

EXAMPLE 1

Cigarettes substantially as shown in FIGS. 1 and 1A are prepared as follows:

The cigarettes each have a length of about 84 mm and a circumference of about 24.8 mm, and include a tobacco rod having a length of 57 mm and a filter element having a length of about 27 mm. Each filter element includes cellulose acetate tow circumscribed by nonporous paper plug wrap. The filter material is a cellulose acetate tow item (3.3 denier per filament; 35,000 total denier) plasticized using triacetin. Each filter element is attached to each tobacco rod using nonporous tipping paper. For each cigarette, the tipping paper circumscribes the filter element and about a 4 mm length of the tobacco rod in the region adjacent the filter element. The filter elements are ventilated to an air dilution level of about 20 percent by providing a ring of perforations through the tipping paper about 13 mm from the extreme mouth end of the cigarette.

The smokable blend consists of tobacco material which has been cased with a casing mixture. The tobacco material has the form of a so-called "American blend", and includes flue-cured, Burley and Oriental tobaccos as well as reconstituted tobacco from a papermaking process and volume expanded flue-cured and Burley tobaccos. The blend of tobacco materials is cased using a mixture of glycerin, water and flavors. The blend is in the form of strands or shreds cut at 32 cuts per inch (i.e., in cut filler form) and is equilibrated to a moisture level of about 12.5 percent. Each cigarette rod includes about 700 mg tobacco material.

The second or outer cigarette paper wrap is a wood pulp/calcium carbonate paper available as P-2831-102 from Kimberly-Clark Corp. The paper wrap exhibits an air permeability of about 1 CORESTA unit and a basis weight of about 30 g/m$^2$. The paper wrap has about 1.1 percent sodium carboxymethylcellulose applied thereto, and 5.3 percent potassium citrate applied thereto.

The first or inner cigarette paper wrap is provided as follows: In about 0.45 l tap water at ambient temperature is contacted about 2.5 g of a blend of Oriental tobaccos in cut filler form and about 50 ml of about 1 percent softwood pulp in water. The softwood pulp is available as Hibrite Pulp, and the pulp exhibits a freeness of 85. The resulting mixture is agitated at high speed in a Waring Blender for about 5 minutes. To the resulting slurry is added about 50 ml of about 1.5 percent tobacco stem pulp in water. The pulp exhibits a freeness of 130, about 1.5 g magnesium hydroxide powder available as 325 Mesh (U.S.) pass powder from ALPHA Products, and about 1.5 g precipitated calcium carbonate particles available as Albacar 5970 from Pfizer, Inc. The resulting mixture is blended in the blender for about 1 minute at low speed. The resulting slurry is poured into a papermaking headbox equipped with a 100 mesh (U.S.) screen, and a paper sheet is provided in a conventional manner. The resulting sheet is dried at about 100° C. The resulting sheet exhibits a thickness of about 0.31 mm and a dry weight basis weight of about 53 g/m$^2$. The paper has 4.7 percent potassium citrate applied thereto.

The tobacco rod is such that the inner wrap circumscribes the smokable blend and the outer wrap circumscribes the inner wrap. The inner and outer wraps directly contact one another (i.e., the inner surface of the outer wrap contacts the outer surface of the inner wrap.

The cigarettes are employed by burning the tobacco rod such that the blend of smokable material within the paper wrapper burns to yield smoke. When employed, such cigarettes yield very low levels of visible sidestream smoke and sustains smolder under static burning conditions after the lighting puff such that the total burnable length of the tobacco rod is consumed (i.e., the cigarette does not self-extinguish).

For comparison purposes, an 84 mm cigarette having a tobacco rod of 57 mm length, a filter element of 27 mm length and a circumference of 24.8 mm is provided. The cigarette is air diluted to about 30 percent by laser perforations encircling the filter element and tipping about 13 mm from the extreme mouthend of the cigarette. The smokable blend is 100 percent of the cased tobacco material blend employed to provide the previously described cigarette of this Example. The tobacco rod includes a single layer of paper wrap. The cigarette paper is available as Reference No. 719 from Ecusta Corp., and exhibits an air permeability of 29 CORESTA units. The packing density of the tobacco blend within the tobacco rod is about 0.23 g/cm$^3$. The comparison cigarette is smoked and yields more visible sidestream smoke than the previously described cigarette of this Example.

EXAMPLE 2

A cigarette is provided as described in Example 1, except that (i) the cigarette is ventilated to about a 60 wrapping material has about 4.7 percent potassium citrate and about 16 percent of an aqueous extract of Oriental tobaccos applied thereto.

EXAMPLE 3

A cigarette is provided as described in Example 1, except that the inner wrap comprises about 10 percent magnesium hydroxide, about 75 percent Oriental tobacco cut filler and about 15 percent wood pulp, which has about 40 percent Oriental tobacco aqueous extract applied to the base sheet.

EXAMPLE 4

A cigarette is provided as described in Example 3, except that the inner wrap comprises about 15 percent magnesium hydroxide, about 70 percent Oriental tobacco cut filler and about 15 percent wood pulp.

What is claimed is:

1. A cigarette comprising a smokable rod including smokable material contained in first and second circumscribing outer wrapping materials; the first wrapping material circumscribing the smokable filler material, and the second wrapping material circumscribing and overwrapping the first wrapping material; the first wrapping material including (a) cellulosic base web, (b) magnesium hydroxide, or magnesium oxide or both, and (c) tobacco, and the second wrapping material (i) having a cellulosic basic web and inorganic filler material, and (ii) exhibiting an air permeability below about 8 CORESTA units.

2. The cigarette of claim 1 wherein the smokable material consists essentially of tobacco filler material.

3. The cigarette of claim 1 wherein the smokable material consists of tobacco filler material.

4. The cigarette of claim 2 wherein the tobacco filler material includes casing, top dressing components or both.

5. The cigarette of claim 1, 2, 3 or 4 wherein the second wrapping material exhibits an air permeability below about 5 CORESTA units.

6. The cigarette of claim 1, 2, 3 or 4 wherein the second wrapping material exhibits an air permeability below about 3 CORESTA units.

7. The cigarette of claim 1, 2, 3 or 4 wherein the second wrapping material exhibits an air permeability below about 1 CORESTA unit.

8. The cigarette of claim 1, 2, 3 or 4 wherein the first wrapping material includes greater than about 2 percent carbonaceous material therewithin, based on the total weight of the smokable rod.

9. The cigarette of claim 1, 2, 3 or 4 wherein the first wrapping material includes greater than about 3 percent carbonaceous material therewithin, based on the total weight of the smokable rod.

10. The cigarette of claim 1 wherein each of the wrapping materials include burn chemical.

11. The cigarette of claim 1, 2, 3 or 4 wherein the second wrapping material includes a polymeric film-forming agent.

12. The cigarette of claim 6 wherein the second wrapping material includes a polymeric film-forming agent.

13. The cigarette of claim 1, 2, 3 or 4 wherein the second wrapping material includes an inorganic filler material.

14. The cigarette of claim 13 wherein the inorganic filler material is calcium carbonate.

15. The cigarette of claims 1, 2, 3 or 4 wherein the cellulosic base web of each of the wrapping materials includes flax.

16. The cigarette of claim 13 wherein the cellulosic base web of each of the wrapping materials includes flax.

17. The cigarette of claim 1, 2, 3 or 4 wherein the tobacco of the first wrapping is in the form of tobacco parts having a cellulosic component.

18. The cigarette of claim 17 wherein the tobacco in the form of tobacco parts having a cellulosic component is shredded tobacco stem or tobacco laminae.

19. The cigarette of claim 1, 2, 3 or 4 wherein the tobacco of the first wrapping material is in processed form.

20. The cigarette of claim 1, 2, 3 or 4 wherein the tobacco of the first wrapping material is in the form of an extract.

21. The cigarette of claim 1, 2, 3 or 4 wherein the amount of tobacco within the inner wrapping material exceeds about 25 percent based on the dry weight of the wrapping material.

22. The cigarette of claim 1, 2, 3 or 4 wherein the amount of tobacco within the inner wrapping material exceeds about 50 percent based on the dry weight of the wrapping material.

* * * * *